United States Patent [19]

Strampfer et al.

[11] 4,231,211

[45] Nov. 4, 1980

[54] METHOD AND APPARATUS FOR SEALING THE FILL OPENINGS OF HARD GELATINE CAPSULES FILLED WITH LIQUID

[75] Inventors: Armin Strampfer, Waiblingen; Guenther Voegele, Schönaich, both of Fed. Rep. of Germany

[73] Assignee: Robert Bosch GmbH, Stuttgart, Fed. Rep. of Germany

[21] Appl. No.: 949,930

[22] Filed: Oct. 10, 1978

[30] Foreign Application Priority Data

Oct. 25, 1977 [DE] Fed. Rep. of Germany ..... 2747696

[51] Int. Cl.[3] ..... B65B 3/02; B65B 3/14

[52] U.S. Cl. ..... 53/452; 53/468; 53/476; 141/329

[58] Field of Search ..... 53/404, 467, 468, 454, 53/559, 471, 476, 486, 560, 488, 489, 574, 578; 141/19, 329, 330, 311 R

[56] References Cited

U.S. PATENT DOCUMENTS

| | | | |
|---|---|---|---|
| 1,138,749 | 5/1915 | Green | 141/329 X |
| 1,241,352 | 9/1917 | Doering et al. | 141/330 X |
| 2,541,272 | 2/1951 | Murphy | 141/329 X |
| 3,245,200 | 4/1966 | Shaw | 141/329 X |
| 3,247,640 | 4/1966 | Miles et al. | 53/404 X |
| 3,340,671 | 9/1967 | Loo | 53/468 X |
| 3,932,977 | 1/1976 | Ringler | 141/329 X |

FOREIGN PATENT DOCUMENTS

| | | | |
|---|---|---|---|
| 1566543 | 1/1970 | Fed. Rep. of Germany | 53/404 |

*Primary Examiner*—Horace M. Culver
*Attorney, Agent, or Firm*—Edwin E. Greigg

[57] ABSTRACT

A method and apparatus is proposed for sealing hard gelatine capsules or similar hollow containers filled with liquid, so that a secure sealing of the fill opening is attained with the aid of a sealant and in which an escape of the sealant—as a result of which the fill opening would be sealed either incorrectly or not at all—is avoided.

3 Claims, 6 Drawing Figures

METHOD AND APPARATUS FOR SEALING THE FILL OPENINGS OF HARD GELATINE CAPSULES FILLED WITH LIQUID

BACKGROUND OF THE INVENTION

For some time, the pharmaceutical industry has recognized the need for filling hard gelatine capsules with liquid medicines as well (i.e., in addition to the conventional powdered fillings for hard gelatine capsules). To meet this need, a sealed hard gelatine capsule or the like is used which either already contains one or more fill openings, or else in which a fill opening is created during the filling procedure—preferably by means of the filling device itself. Then, with the aid of a hollow needle, the hard gelatine capsule is filled and is finally sealed by means of having a sealant globule placed upon the fill opening. This method of filling hard gelatine capsules or the like with liquid has the particular advantage when compared with the method of filling a capsule half that first a better fill level is attained, and second, an overflow of liquid, which can arise when capsule halves are filled, is impossible in this fill method. However, when sealing gelatine capsules, which are thus provided with an opening and then filled, with the aid of a sealant globule, care must be taken that this sealant globule remains in the region of the fill opening and does not escape.

OBJECT AND SUMMARY OF THE INVENTION

The method according to the invention has the advantage above all, besides that of a relatively simple and secure mode of operation, that the drop of sealant placed upon each capsule collects in the recess or depression and does not overflow over the top of the capsule and run down the side, and thus that contamination of the capsule is avoided. It is of further advantage that in this method most of the substance of the sealant collects in the region of the pricking point, so that a tight and therefore secure sealing of the fill opening is accomplished. Furthermore, by means of placing a correctly dosed amount of sealant upon the capsule, it can be accomplished that the capsule again has nearly its original shape—that is, the shape which the capsule has before the top or dome-shaped wall was pressed in.

Furthermore, in accordance with the method as taught by this application, there is also the advantage that the creation of the recess or depression in the dome-shaped wall of the capsule and the subsequent sealing of the fill opening can be carried out with relatively simple and securely operating means.

The invention will be better understood as well as further objects and advantages thereof become more apparent from the ensuing detailed description of a preferred embodiment taken in conjunction with the drawings.

DESCRIPTION OF THE PREFERRED EMBODIMENT

Figure 1:
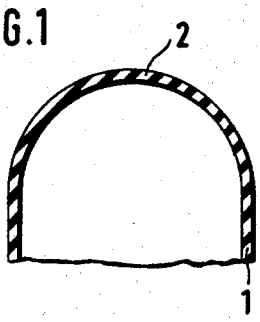
FIG. 1 is a sectional view of the top end of one half of a hard gelatine capsule in its original form.
Figure 2:
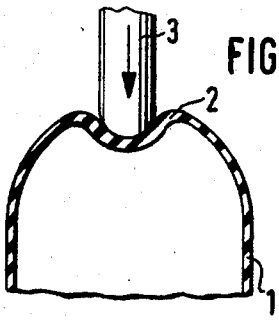
FIG. 2 is a similar view showing a depression in the top end of one half of a hard gelatine capsule.
Figure 3:
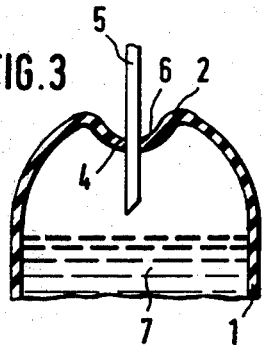
FIG. 3 shows a hollow needle after it has formed a fill opening and begun to fill the capsule.
Figure 4:
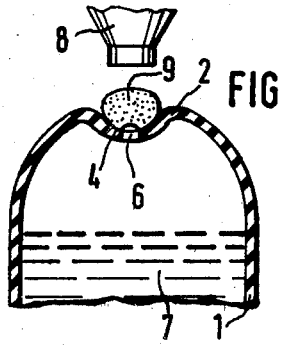
FIG. 4 shows a punctured top wall of a capsule provided with a drop of a sealant positioned over the punctured fill opening.
Figure 5:
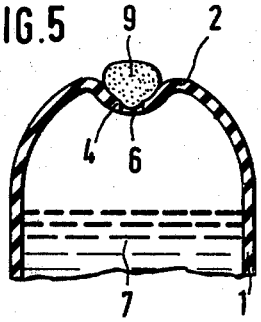
FIG. 5 shows a sealed hard gelatine capsule after the sealant has jelled.

The figures provided on the sheet of drawing show the filling and sealing of a hard gelatine capsule in a schematic manner. Considering first the hard gelatine capsule 1 shown in FIG. 1, which has a curved or arcuate top 2 in its upper portion which bulges toward the outside, FIG. 2 shows an impression stamp means 3, which presses the curved top wall downwardly toward the inside and thus creates a spherical recess or depression 4. With the aid of a hollow needle 5, finally, a fill opening 6 is formed, as is shown in FIG. 3, and the hard gelatine capsule 1 is filled with liquid 7. Following the filling procedure, as may be seen in FIG. 4, a drop 9 of a sealing mass is placed upon the recess or depression 4 with the aid of a device 8 which is per se known and will not be further described. Thus the fill opening 6 is properly sealed. FIG. 5 shows a sealed hard gelatine capsule 1, onto which the sealing mass 9 has been secured and fills the spherical recess or depression 4 in such a manner that the shape of the top end 2 of the hard gelatine capsule 1 shown in FIG. 1 is nearly of the same shape as it was originally.

Figure 6:
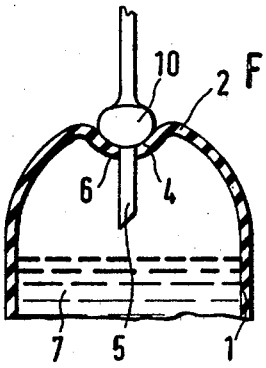
FIG. 6 shows a further embodiment in which the needle for puncturing the capsule is also provided with a device to form the spherical depression in the top wall of the hard gelatine capsule.

In the exemplary embodiment shown in FIG. 6, the arrangement is such that the hollow needle 5 includes a bulge 10, which serves to create the shperical recess or depression 4. In this embodiment, the spherical recess or depression 4 is created after the fill opening 6 has been made by means of the further downward motion of the hollow needle 5. The impression stamp 3 shown in FIG. 2 may be omitted in this embodiment.

If the capsule shape shown in FIG. 5 is to be attained, then the size of the recess or depression 4 must be selected to be such that after the drop 9 of the sealing mass is placed thereupon, the top wall of the hard gelatine capsule 1 is not too severely flattened. It has been demonstrated that the drop 9 when placed upon the recess or depression 4 distributes itself therein in such a way that the original length of the hard gelatine capsule 1 (that is, without being pressed inward) is not quite as long as it was originally. This feature proves to be advantageous in the later packaging of the hard gelatine capsules 1. It is to be understood that it is necessary to apply only a very small drop 9 of the sealing mass in the recessed area of the capsule. By means of the creation of the recess or depression 4, the further advantage results that the placement of the sealing mass need not be precisely centered with respect to the fill opening 6, since the sealing mass runs downward to the fill opening 6.

The foregoing relates to preferred embodiments of the invention, it being understood that other embodiments and variants thereof are possible within the spirit and scope of the invention, the latter being defined by the appended claims.

What is claimed is:

1. A method for filling and sealing hard gelatine capsules or the like having a dome-shaped end wall comprising the steps of, forming a spherical depression in said capsule end wall, inserting a hollow needle through said capsule end wall centrally of said spherical depression to form a fill opening, introducing a medicant into the interior of said capsule through said hollow needle, and filling said spherical depression with a sealing mass to seal said fill opening and conform said end wall containing said spherical depression to substantially its original shape.

2. A method for filling and sealing hard gelatine capsules or the like, having a dome-shaped end wall comprising the steps of, inserting a hollow needle through said dome-shaped end wall of said capsule to form a fill opening, introducing a medicant into the interior of said capsule through said hollow needle, forming a spherical depression in said capsule end wall, withdrawing said hollow needle and filling said spherical depression with a sealing mass to seal said fill opening and conform said end wall containing said spherical depression to substantially its original shape.

3. A method in accordance with claim 1 wherein said depression forming step is carried out during said needle inserting step.

* * * * *